US008672634B2

(12) United States Patent
Parkos et al.

(10) Patent No.: US 8,672,634 B2
(45) Date of Patent: Mar. 18, 2014

(54) ELECTROFORMED CONFORMING RUBSTRIP

(75) Inventors: Joseph Parkos, East Haddam, CT (US); James O. Hansen, Glastonbury, CT (US); Gary M. Lomasney, Glastonbury, CT (US); Thomas M. Morin, Terryville, CT (US)

(73) Assignee: United Technologies Corporation, Hartford, CT (US)

( * ) Notice: Subject to any disclaimer, the term of this patent is extended or adjusted under 35 U.S.C. 154(b) by 802 days.

(21) Appl. No.: 12/871,087

(22) Filed: Aug. 30, 2010

(65) Prior Publication Data

US 2012/0051922 A1 Mar. 1, 2012

(51) Int. Cl.
*F01D 5/30* (2006.01)

(52) U.S. Cl.
USPC ..... 416/219 R; 416/220 R; 416/223 R; 416/224; 416/241 R

(58) Field of Classification Search
USPC ..... 416/219 R, 220 R, 223 R, 224, 241 R
See application file for complete search history.

(56) References Cited

U.S. PATENT DOCUMENTS 2,874,932 A * 2/1959 Sorensen ..... 416/220 R
3,092,558 A 6/1963 Hughes et al.
3,317,988 A * 5/1967 Endres ..... 29/889.21
3,554,874 A 1/1971 Mattia
3,574,075 A 4/1971 Eccles
3,628,890 A 12/1971 Sayre et al.
3,649,474 A 3/1972 Blakeslee et al.
3,715,286 A 2/1973 Knapp
3,784,320 A * 1/1974 Rossmann et al. ..... 416/215
3,836,279 A 9/1974 Lee
3,868,311 A 2/1975 Durin
3,871,840 A 3/1975 Wilder et al.
3,892,612 A 7/1975 Carlson et al.
3,999,888 A 12/1976 Zincone
4,111,600 A 9/1978 Rothman et al.
4,156,306 A 5/1979 Seidel et al.
4,207,029 A * 6/1980 Ivanko ..... 416/241 B
4,232,995 A 11/1980 Stalker et al.
4,417,854 A 11/1983 Cain et al.
4,501,646 A 2/1985 Herbert
4,564,423 A 1/1986 Dugan
4,586,226 A 5/1986 Fakler et al.
4,589,823 A 5/1986 Koffel
4,608,145 A 8/1986 Fairbanks
4,720,244 A 1/1988 Kluppel et al.
4,781,799 A 11/1988 Herbert, Jr. et al.
4,802,828 A 2/1989 Rutz et al.
4,820,126 A 4/1989 Gavilan (Continued)

FOREIGN PATENT DOCUMENTS

GB 2039526 8/1980
WO WO95/09937 4/1995

*Primary Examiner* — Igor Kershteyn
(74) *Attorney, Agent, or Firm* — Carlson, Gaskey & Olds P.C.

(57) ABSTRACT

A disk made of a first material has a groove in which a blade made of a second material is retained. A strip is placed between the blade and the disk to minimize rubbing damage to the blade and the disk and an insulating material is place between the rub strip and the blade for minimizing damaging responses of the blade to galvanic forces created by rubbing of the first material and the second material.

25 Claims, 3 Drawing Sheets

(56) References Cited

U.S. PATENT DOCUMENTS

| | | | | | |
|---|---|---|---|---|---|
| 4,832,252 | A | | 5/1989 | Fraser | |
| 4,842,663 | A | | 6/1989 | Kramer | |
| 4,902,386 | A | | 2/1990 | Herbert et al. | |
| 4,950,375 | A | | 8/1990 | Leger | |
| 5,022,824 | A | | 6/1991 | Violette et al. | |
| 5,033,938 | A | | 7/1991 | Fraser et al. | |
| 5,074,970 | A | | 12/1991 | Routsis et al. | |
| 5,087,174 | A | * | 2/1992 | Shannon et al. | 416/220 R |
| 5,102,300 | A | | 4/1992 | Violette et al. | |
| 5,110,421 | A | | 5/1992 | Gabrielson | |
| 5,129,787 | A | | 7/1992 | Violettet et al. | |
| 5,160,243 | A | * | 11/1992 | Herzner et al. | 416/220 R |
| 5,174,024 | A | | 12/1992 | Sterrett | |
| 5,240,375 | A | * | 8/1993 | Wayte | 416/219 R |
| 5,306,120 | A | | 4/1994 | Hammer et al. | |
| 5,326,647 | A | | 7/1994 | Merz et al. | |
| 5,435,902 | A | | 7/1995 | Andre, Sr. | |
| 5,542,820 | A | | 8/1996 | Eaton et al. | |
| 5,558,500 | A | * | 9/1996 | Elliott et al. | 416/220 R |
| 5,607,561 | A | | 3/1997 | Gruver et al. | |
| 5,665,217 | A | | 9/1997 | Gruver et al. | |
| 5,674,370 | A | | 10/1997 | DuPree | |
| 5,782,607 | A | | 7/1998 | Smith et al. | |
| 5,863,181 | A | | 1/1999 | Bost et al. | |
| 5,908,285 | A | | 6/1999 | Graff | |
| 5,908,522 | A | | 6/1999 | Lofstrom et al. | |
| 6,102,662 | A | | 8/2000 | Bost et al. | |
| 6,290,466 | B1 | * | 9/2001 | Ravenhall et al. | 416/229 A |
| 6,431,835 | B1 | * | 8/2002 | Kolodziej et al. | 416/219 R |
| 6,699,015 | B2 | * | 3/2004 | Villhard | 416/96 A |
| 8,282,356 | B2 | * | 10/2012 | Cairo | 416/219 R |

* cited by examiner

ELECTROFORMED CONFORMING RUBSTRIP

BACKGROUND

Components of gas turbine engines are subject to wear and damage. Even moderate wear and damage in certain components may interfere with optimal operation of the engine. Particular areas of concern involve the airfoils of various blades and vanes. Wear and damage may interfere with their aerodynamic efficiency, produce damaging dynamic force and imbalances, and even, in more extreme cases, structurally compromise or damage parts.

Because blades tend to be forced outwardly within a rotor due to centrifugal forces during operation, wear between interlocking portions of a blade and the rotor in which the blade is disposed is an area of interest.

SUMMARY

According to an exemplar disclosed herein, a disk made of a first material has a groove in which a blade made of a second material is retained. A strip is placed between the blade and the disk to minimize rubbing damage to the blade and the disk and an insulating material is place between the rub strip and the blade for minimizing damaging responses of the blade to galvanic forces created by rubbing of the first material and the second material.

According to a further exemplar disclosed herein, a blade made of a first material for retention within a disk made of a second material has a strip placed thereon for minimizing rubbing damage to the blade from the disk, and an insulating material is disposed between the rub strip and the blade for minimizing response of the blade to galvanic forces.

According to a still further exemplar disclosed herein, a die has an electroforming body having a shape conforming to a portion of a shape of a root of a blade. The portion conforms to areas of the root in which rubbing between the blade and a disk occurs. The body has a non-conductive strip to create a gap in a part electroformed on the die so that the part may be easily removed from the die.

According to a still further exemplar disclosed herein, rub strip for use with a disk made of a first material and having a groove that holds a blade root made of a second material, has a strip having a contour closely mimicking a contour of the blade root and the groove for placement between the blade root within the groove, the strip minimizing rubbing damage to the blade, and an insulating material disposed on a inner surface of said strip between the rub strip and the blade for minimizing damaging responses of the blade to galvanic forces between the first material and the second material.

These and other features of the disclosed examples can be best understood from the following specification and drawings, the following of which is a brief description.

DETAILED DESCRIPTION

Figure 1:
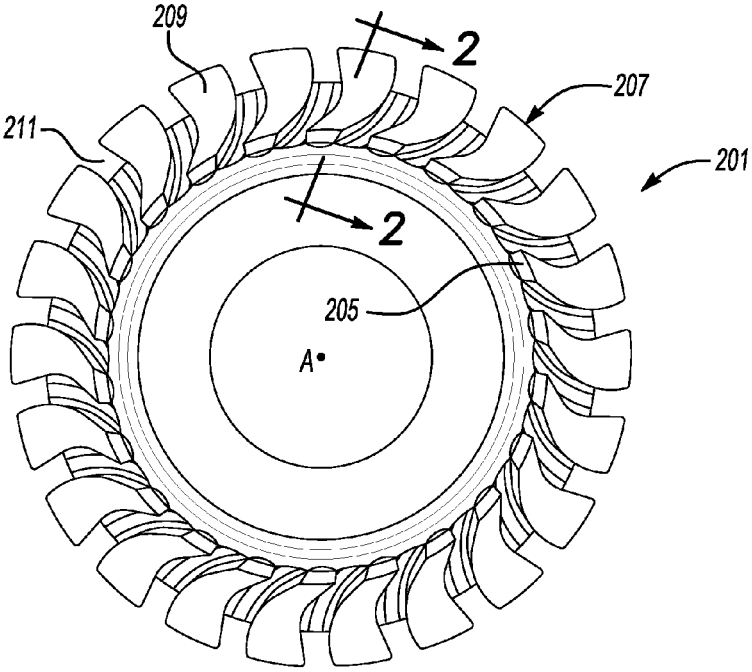
FIG. 1 is a perspective view of a rotor having a blade seated therein.
Figure 2:
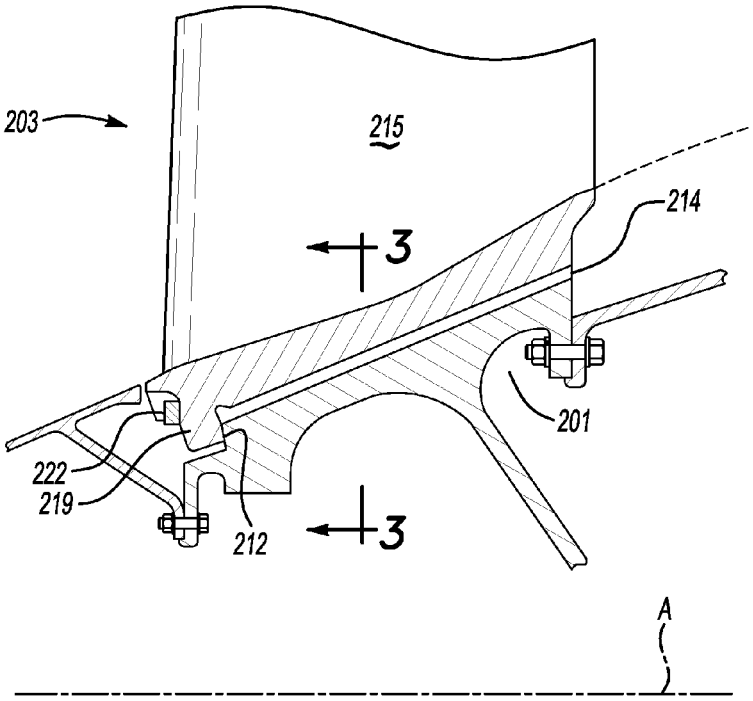
FIG. 2 is a cross-sectional view taken along the lines 2-2 of FIG. 1 partially cutaway.

Referring to FIGS. 1 and 2, a disk 201 for use in a gas turbine engine, not shown, having an annular shape, a front face 205, a rear face 207 and an outer surface 209 is shown. Grooves 211, which may follow a rectilinear path through the outer surface 209 of the disk 201 from the front face 205 to the rear face 207, extend at an angle to an axial centerline A. Though grooves 211 form a dovetail (see FIG. 3) shape 213, other shapes that secure a blade 203 to the disk 201 are contemplated herein. The disk may be made of titanium or an alloy thereof.

Figure 3:
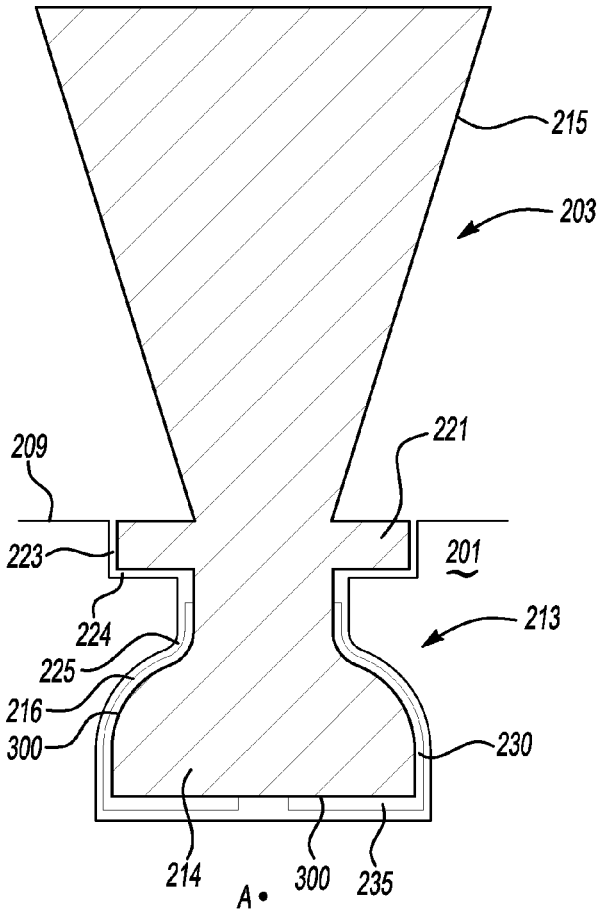
FIG. 3 is a cutaway view of the blade and rotor taken along the lines 2-2 of FIG. 2.

As seen in FIGS. 2 and 3, a blade 203 has a root portion 214 placed within the grooves 211 of the disk 201. The root portion 214 has a contour 216 that closely mimics the dove tail shape 213 of the grooves 211 for retention of the blade 203 therein. Though the fit between the contour 216 and the shape 213 is close to an interference fit, space between the root portion 214 and the groove 211 exists due to imperfection in manufacturing techniques and to enable the blade 203 to be inserted and removed efficiently. The root portion 214 has a tab 219 depending therefrom towards the axial center line A that abuts a shoulder 212 in the disk 201 to position properly and limit the travel of the blade 203 during insertion of the blade 203 into the groove 211. A split lock ring 222 is placed behind the blades and the disk 201 to minimize forward movement of the blades 203. The tabs 219 also minimize rearward movement of the blades. The blade 203 may be constructed of aluminum or other alloys.

Figure 4:
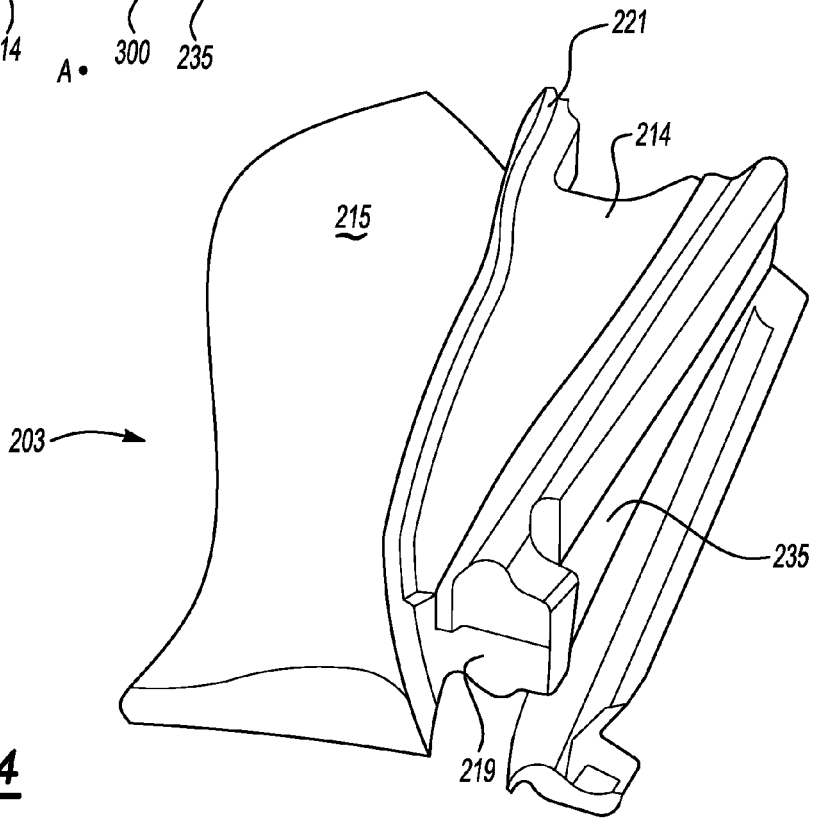
FIG. 4 shows a view of the root structure of the blade of FIG. 3.
Figure 5:
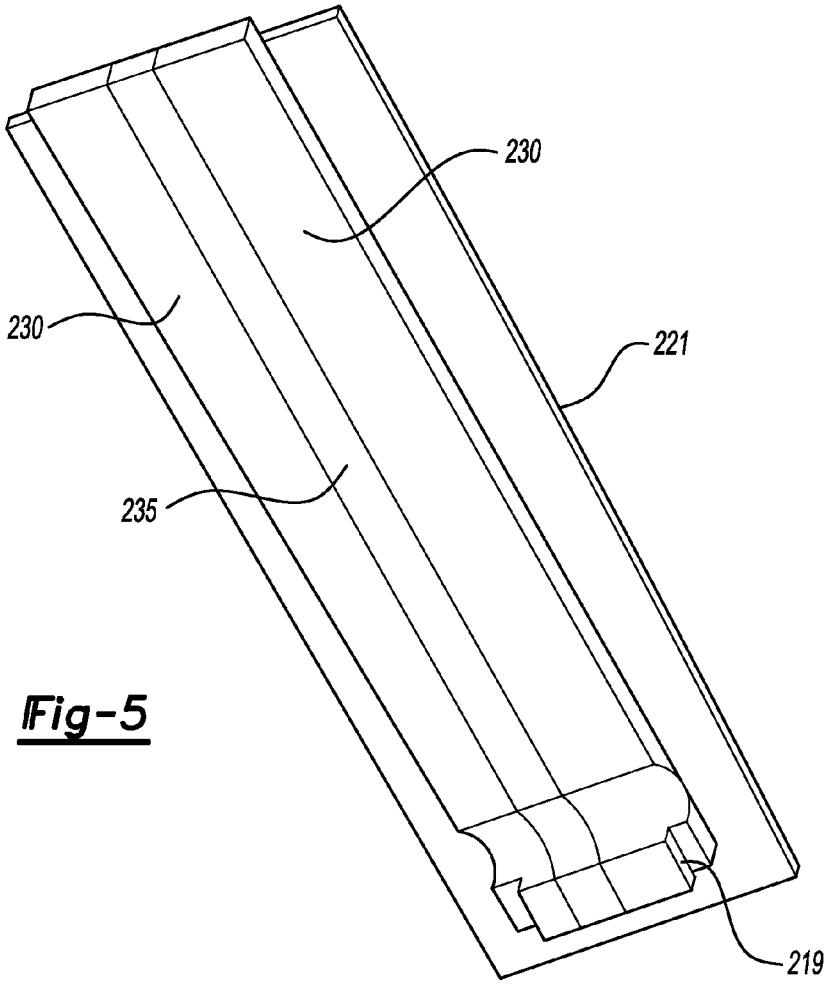
FIG. 5 shows a perspective view of the blade of FIG. 3.

Referring now to FIGS. 3, 4 and 5, the blade 203 includes a platform 221 between the root portion 214 and an airfoil 215. After installing the blades 203 into the grooves 211 of the disks 201, the platform 221 serves the fill in gaps 223, 224 and 225 which are exaggerated for ease of viewing. The platform 221 defines a small portion of the inner boundary of the core engine flow path (not shown). As seen in FIG. 3, the platforms 221 are flush with the outer surface 209 of the disk 201. Though the gap 225 may be small, during operation, as the disk spins, centrifugal forces move the blades 203 radially outwardly away from centerline A so that gap 225 is eliminated and potentially damaging rubbing between the root portion 214 and the disk 201 may occur.

Figure 6:
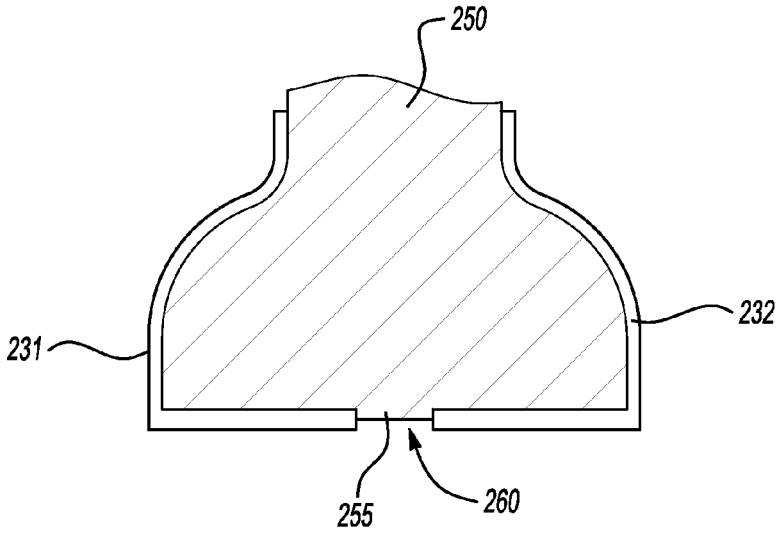
FIG. 6 is a view of an example die.

Referring now to FIGS. 4, 5 and 6, a rub strip 230, which may be electroformed, as will be discussed hereinbelow, is disposed on the contour 216, a bottom portion 235, and the tab 219 of the root portion 214. The rub strip 230 closely mimics the shape of the contour 216, a bottom portion 235, and the tab 219 of the root portion 214 so that the gap 225 is minimized. During operation, the rub strip contacts the disk 201 and minimizes damage to the root portion 214 of the blade 203.

A bonding agent 300, such as an epoxy glue as is known in the art, is used to electrically isolate the rub strip 230 from the blade 203 and its root portion 214. The bonding agent 300 minimizes galvanic reaction caused by moisture and rubbing of dissimilar metals between the rub strip 230 and the root portion 214 that might tend to degrade the root portion 214. The bonding agent 300 also minimizes rub strip 230 slippage.

Referring to FIG. 6, a die 250 shaped like the contour 216 of the blade 203 is plated by using electric current to reduce cations of a desired material to coat the die 250. The die 250 may be made of a conductive nickel titanium and the layer of material deposited thereon forms a rub strip 230. A nano-nickel/cobalt or a conventional nickel material, or the like could be a suitable material for electroplating on the die 250. The rub strips 230 provide wear resistance and corrosion protection. The rub strips have complementary halves 231, 232 formed on the die 250 so that the halves 231 and 232 are easily removed from the die 250. The halves are created by positioning a non-conductive strip 255 on the bottom of the die to create a gap 260 between the halves. Because the die 250 mimics that contour 216, the halves 231 and 232 are easily glued to the root portion 214.

If a blade 203 is placed within groove 211 as the disk 201 spins, the blade is moved radially outwardly from centerline A and the rub strip halves 231, 232 are brought into contact with the grooves 211. The rub strip halves 231, 232 absorb rubbing to minimize fatigue and wear within the blade root.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. An assembly comprising;

a disk having a groove, said disk made of a first material;

a blade retained within said groove, said blade being made of a second material;

a strip placed between said blade and said disk, said strip minimizing rubbing damage to said blade and said disk, wherein said strip is a nano-based nickel; and an insulating material between said strip and said blade for minimizing damaging responses of said blade to galvanic forces between said first material and said second material.

2. The assembly of claim 1 wherein said blade further comprises a root portion that has a first shape that is similar to a second shape of said groove.

3. The assembly of claim 2 wherein said strip encloses at least a portion of said root portion.

4. The assembly of claim 3 wherein said portion of said root portion includes areas that would rub against the disk during operation thereof but for the strip.

5. The assembly of claim 1 wherein said blade is made of an aluminum-based material.

6. The assembly of claim 5 wherein said disk is made of a titanium-based material.

7. The assembly of claim 1 wherein said groove forms a dovetail shape having a radially inward bottom and a relatively radially outwardly disposed top and a root portion of said blade is retained in said dovetail shape wherein said root portion has a shape similar to the dovetail shape.

8. The assembly of claim 7 wherein the strip attaches to said root portion in the vicinity of the relatively outwardly disposed top.

9. The assembly of claim 7 wherein the strip attaches to said root portion in the vicinity of the relatively radially inwardly disposed bottom.

10. The assembly of claim 1 wherein said strip comprises a first portion and a second portion and said first portion attaches to a first side of a root portion of said blade and said second portion attaches to a second side of a root portion of said blade.

11. The assembly of claim 10 wherein each of said first portion and said second portion are disposed on a side face and a bottom of the root portion, and wherein there is a gap between said first portion and said second portion adjacent the bottom of the root portion.

12. The assembly of claim 10 wherein said first and second sides of said root portion include a portion that would be in rubbing contact with said disk but for the strip.

13. The assembly of claim 1 wherein said strip at least partially encloses an axial stop tab of said blade.

14. The assembly of claim 1 wherein the insulating material includes a bonding agent.

15. The assembly of claim 14 wherein the bonding agent includes an epoxy glue.

16. An assembly comprising;

a blade made of a first material for retention within a disk made of a second material;

a strip placed upon said blade for minimizing rubbing damage to said blade from said disk, wherein said strip comprises a first portion and a second portion, said first portion attached to a first side of a root portion of said blade and said second portion attached to a second side of a root portion of said blade, each of said first portion and said second portion disposed on a bottom of the root portion, and wherein there is a gap between said first portion and said second portion adjacent the bottom of the root portion; and an insulating material between said strip and said blade for minimizing response of said blade to galvanic forces.

17. The assembly of claim 16 wherein said blade further comprises a root portion for insertion in said disk and wherein said insulating material is disposed between said strip and said root portion.

18. The assembly of claim 17 wherein said strip is disposed in an area of said root portion wherein said blade would be in rubbing contact with said disk during operation of said disk.

19. A die comprising;

an electroforming body, said body having:

a shape conforming to a portion of a shape of a root of a blade, said portion conforming to areas of said root in which rubbing between said blade and a disk occur; and a non-conductive strip thereon so that a gap between a part electroformed on said die is created so that said part may be easily removed from said die.

20. The die of claim 19 wherein said gap is on a bottom portion of said die.

21. A rub strip for use with a disk made of a first material and having a groove that holds a blade root made of a second material, said rub strip comprising;

a strip having a contour closely mimicking a contour of said blade root and said groove for placement between said blade root within said groove said strip minimizing rubbing damage to said blade; and an insulating material placed on an inner surface of said strip for attaching to said blade, and for minimizing damaging responses of said blade to galvanic forces between said first material and said second material, wherein said insulating material is a glue.

22. The rub strip of claim 21 wherein said rub strip has a portion for at least partially enclosing an axial stop tab of said blade.

23. The rub strip of claim 21 wherein said rub strip has a first half and a second half each half for enclosing at least a portion of a side of said blade root.

24. The rub strip of claim 21 wherein said rub strip halves do not meet each other if placed on said blade root.

25. The rub strip of claim 24 wherein, when said rub strip halves are placed on said blade root, said rub strip halves are spaced-apart from one another adjacent a bottom of said blade root.

* * * * *